US009604356B2

(12) United States Patent
Golias, Jr. et al.

(10) Patent No.: US 9,604,356 B2
(45) Date of Patent: Mar. 28, 2017

(54) SLOPED BIN COVER

(71) Applicants: Bernard J. Golias, Jr., Twinsburg, OH (US); Gary W. James, Parma Heights, OH (US); Judy Kalski, Westlake, OH (US)

(72) Inventors: Bernard J. Golias, Jr., Twinsburg, OH (US); Gary W. James, Parma Heights, OH (US); Judy Kalski, Westlake, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 0 days.

(21) Appl. No.: 14/302,939

(22) Filed: Jun. 12, 2014

(65) Prior Publication Data

US 2015/0359333 A1 Dec. 17, 2015

Related U.S. Application Data

(60) Provisional application No. 61/834,617, filed on Jun. 13, 2013.

(51) Int. Cl.

| | |
|---|---|
| ***A47F 9/00*** | (2006.01) |
| ***B25H 3/00*** | (2006.01) |
| *A47B 47/02* | (2006.01) |

(52) U.S. Cl.

CPC ..... *B25H 3/00* (2013.01); *A47B 47/02* (2013.01)

(58) Field of Classification Search

CPC ..... A47B 19/00; A47B 47/02; B25H 3/00
USPC ..... 312/137, 231
See application file for complete search history.

(56) References Cited

U.S. PATENT DOCUMENTS

| | | | | | |
|---|---|---|---|---|---|
| 119,316 | A * | 9/1871 | Carter et al. | A47B 83/001 | 312/196 |
| 468,929 | A * | 2/1892 | Cochrane | A47B 41/02 | 108/32 |
| 818,910 | A * | 4/1906 | Owens | A47G 19/26 | 312/196 |
| 1,481,762 | A * | 1/1924 | Torbet | 312/137 | |
| 1,696,317 | A * | 12/1928 | O'Boyle | A47F 5/00 | 312/100 |
| 3,743,231 | A * | 7/1973 | Whyte | 248/452 | |
| 4,538,861 | A * | 9/1985 | Hughes, Jr. | 312/244 | |
| 4,735,150 | A * | 4/1988 | Roberts | 108/38 | |
| 5,058,965 | A * | 10/1991 | Thorn | 312/231 | |
| 5,244,265 | A * | 9/1993 | Chiang | B25H 3/023 | 312/107 |
| 5,456,358 | A * | 10/1995 | Schmidt | B25H 3/02 | 206/372 |

(Continued)

*Primary Examiner* — Daniel J Troy
*Assistant Examiner* — Andres F Gallego
(74) *Attorney, Agent, or Firm* — Fay Sharpe LLP; James E. Scarbrough

(57) ABSTRACT

A sloped cabinet header or top member for use with a storage cabinet has a front wall, a rear wall, an angled top wall extending between the front and rear walls, and a bottom wall extending between the front and rear walls. First and second side walls interconnect the top, front, rear, and bottom walls. The top wall is angled with respect to the rear wall and bottom wall. The top member is mounted onto an upper surface of the storage cabinet to prevent storage of components on the top surface of the cabinet and to prevent dust or debris from accumulating on the upper surface of the cabinet.

11 Claims, 6 Drawing Sheets

(56) References Cited

U.S. PATENT DOCUMENTS

| | | | | |
|---|---|---|---|---|
| 5,694,862 | A * | 12/1997 | Grubb | A47B 83/001 108/50.11 |
| 6,460,946 | B1 * | 10/2002 | Beukema | A47B 43/00 108/152 |
| 7,971,716 | B2 * | 7/2011 | Eaton | 206/373 |
| 2004/0256535 | A1 * | 12/2004 | Desch | 248/460 |

* cited by examiner

FIG. 1
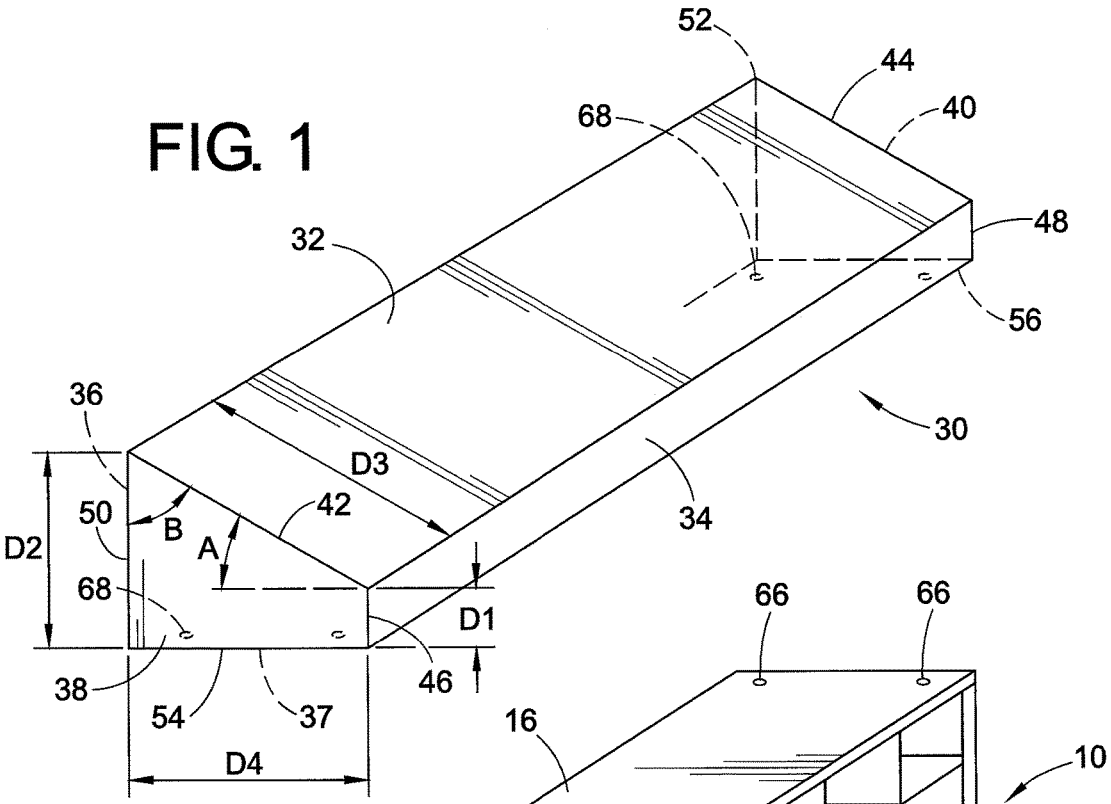
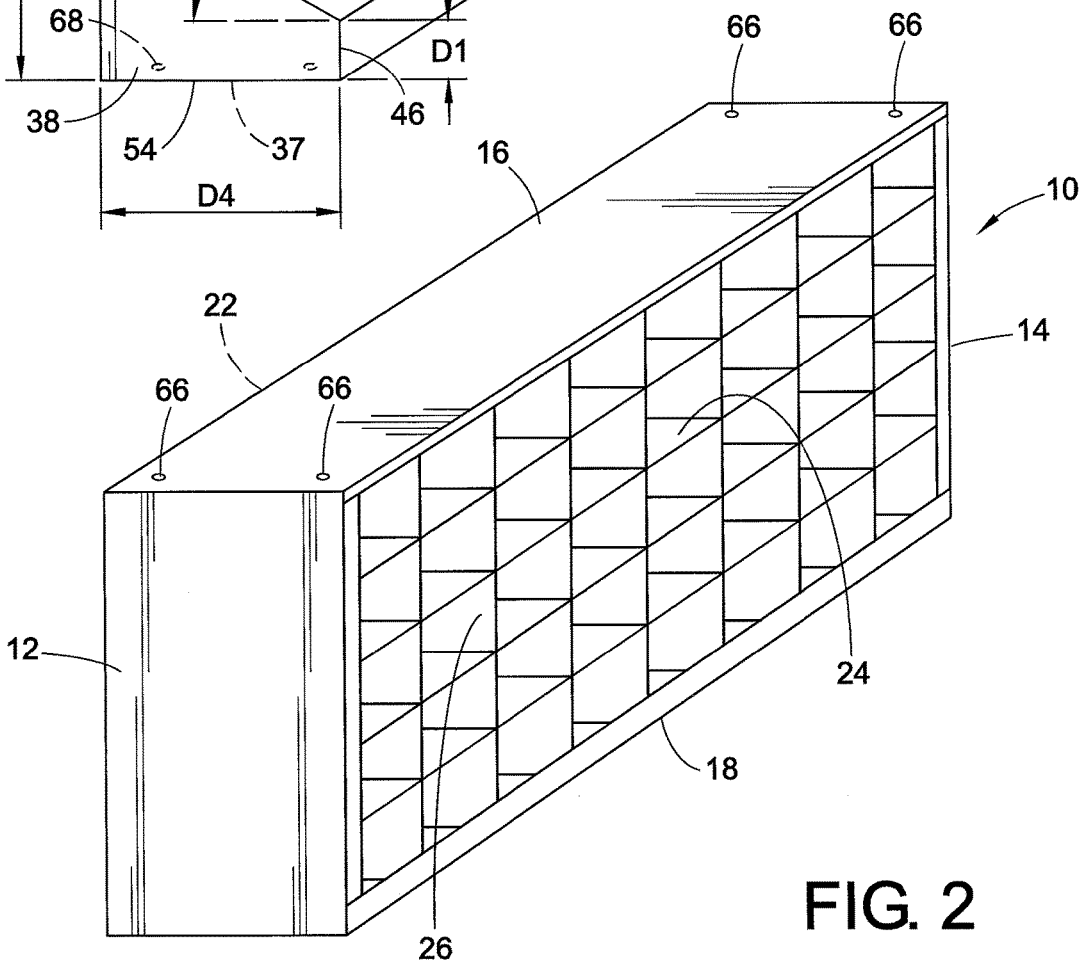
FIG. 2

SLOPED BIN COVER

CLAIM OF PRIORITY

This application claims priority from Provisional Patent Application Ser. No. 61/834,617, filed on Jun. 13, 2014, which is hereby incorporated by reference in its entirety.

BACKGROUND OF THE DISCLOSURE

The present disclosure relates to storage cabinets and shelving. More particularly, it relates to a sloped or angled bin top member or header which prevents toppling of the storage cabinet and strengthens the overall assembly.

Metal compartment bins and cabinets are some of the most versatile pieces of furniture available. The cabinets can be hung in work areas such as metal or woodworking shops, garages, as well as many other places. Cabinets and compartment bins can also provide storage in vehicles such as trucks and vans. Metal cabinets also provide versatility in what they store. For example, metal cabinets and compartment bins have been used to store threaded rod, wire, brake line, welding rods, as well as more common items such as tools and fasteners.

Bins or cabinets having a plurality of compartments are usually assembled with numerous amounts of attachments between the components. For example, shelves can be mechanically fastened or welded to dividers. Other cabinets and bins have slidable surface drawers therein.

Oftentimes the users of the bin or cabinet will use the top wall or surface as a shelf and place articles on the top surface drawers therein which may make the bin unstable and topple or fall over. This may result in injury to the user as well as damage to the cabinet and/or the articles therein or on top of the cabinet. Moreover, excess dust can accumulate on the top surface of the cabinet. Accordingly, there is a need for a sloped bin header which will overcome the above mentioned deficiencies and others while providing better overall results.

SUMMARY OF THE DISCLOSURE

According to an aspect of the disclosure, a metal cabinet includes a plurality of shelf members and a plurality of dividers. Preferably, the shelf members are horizontally oriented in the cabinet and the dividers are vertically oriented.

In accordance with another aspect of the disclosure, a cabinet or bin has a plurality of slidable drawers mounted within the cabinet.

In accordance with another aspect of the disclosure, a sloped bin top member has a sloped or angled top wall for preventing placement of articles thereon.

In accordance with another aspect of the disclosure, the sloped bin member is positioned on the top surface of a cabinet with shelves or drawers.

In accordance with still another aspect of the disclosure, the sloped bin member has a door formed on one of the side walls of the sloped bin header for storage of items within the sloped bin header.

In accordance with one aspect of the disclosure, a top member for use with a metal storage cabinet, includes a front wall, a rear wall, an angled top wall extending between the front and rear walls, and a bottom wall extending between the front and rear walls; and first and second side walls interconnecting the top, front, rear, and bottom walls; wherein the top wall is angled with respect to the bottom wall; and wherein the top member is adapted to be mounted onto an upper surface of the metal cabinet.

In accordance with another aspect of the disclosure, a sloped bin cover and storage cabinet assembly includes a cabinet having an upper wall, side walls, a bottom wall and rear wall and at least one opening in a front portion of the cabinet; a sloped bin cover has a front wall, a rear wall, a top wall extending between the front and rear walls, and a bottom wall extending between the front and rear walls; and first and second side walls interconnecting the top, front, rear, and bottom walls; wherein the top wall is angled with respect to the first, rear and bottom walls; and wherein the top member is adapted to be mounted onto an upper surface of the cabinet.

In accordance with another aspect of the disclosure, a top member for use with a storage cabinet has, a front wall, a rear wall, an angled top wall extending between the first and rear walls, and a bottom wall extending between the front and rear walls. First and second side walls interconnect the top, front, rear, and bottom walls. The top member is adapted to be mounted onto an upper surface of the storage cabinet.

In accordance with another aspect of the disclosure, a method of preventing placement of articles on a top surface of a cabinet, includes the following steps: providing a top member having a sloped top wall, a bottom wall, a rear wall, and first and second side walls; providing openings in the bottom wall of the top member; providing openings in the top surface of the cabinet; and mounting the top member to the cabinet via fasteners extending through the openings of the top member and the openings of the cabinet.

Still another aspect of the disclosure is a sloped bin header and cabinet assembly which is mounted to a base stand.

Still another aspect of the disclosure is a sloped bin having an angled front surface and is formed of one piece.

Other aspects of the disclosure will become apparent upon a reading and understanding of the following detailed description.

BRIEF DESCRIPTION OF THE DRAWINGS

The disclosure takes form in certain parts and arrangements of parts, preferred embodiments of which will be described in detail in this specification and illustrated in the accompanying drawings which form a part hereof and wherein:

FIG. 1 is a perspective view of a sloped bin top member in accordance with one aspect of the disclosure;

FIG. 2 is a perspective view of a storage cabinet in accordance with one aspect of the disclosure;

DETAILED DESCRIPTION OF THE DISCLOSURE

Figure 3:
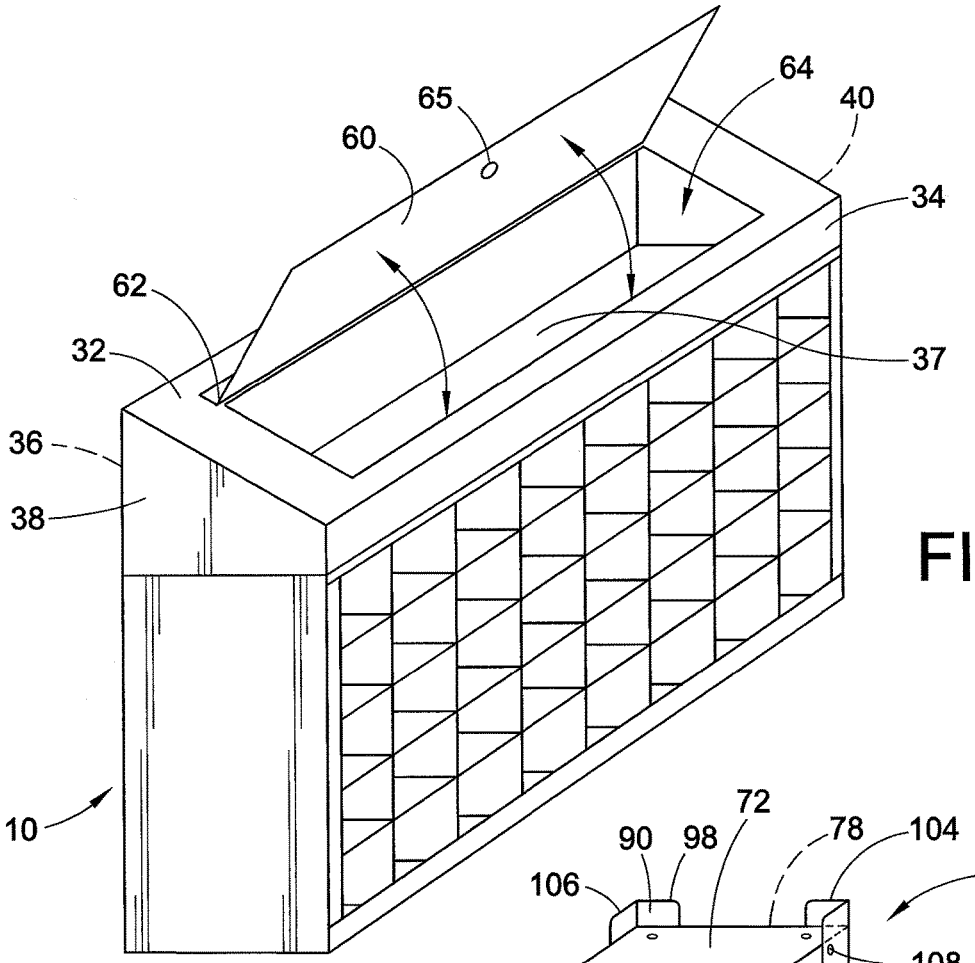
FIG. 3 is a perspective view of a sloped bin top member having a door therein mounted on a storage cabinet in accordance with another aspect of the disclosure.

Referring now to the Figures, the showings are for purposes of illustrating the preferred embodiments of the invention only and are not for purposes of limiting same. Directional terms such as "top", "bottom", "left", "right", "front", "rear", and the like will be used to simplify the description of the Figures only, and should not be construed as limiting the components to those directional terms.

Referring now to FIGS. 1 and 2, a compartment storage bin or cabinet 10 is shown in accordance with one aspect of the disclosure. The compartment bin includes a first or left side wall 12 and a second or right side wall 14 spaced from wall 12. A third or top panel 16 and a fourth or bottom panel 18 spaced from the top panel interconnect the two side walls. A fifth or rear panel 22 interconnects with the top and bottom panels and the two side walls. The bin further has a plurality of horizontal shelves 24 and vertical divider walls 26 forming compartments within the bin. The bin or cabinet is preferably made of metal, but other materials may be used.

A sloped bin header or top member 30 is shown in FIG. 1 as positioned above the cabinet 10. The sloped header 30 has a first or top wall 32 which is angled or sloped at an angle A with respect to rear wall 36 and is angled at an angle B with respect to rear wall 36. Bottom wall 37 extends between a front wall 34 and rear wall 36. Front wall 34 is shown as an elongated narrow rectangular wall, while rear wall 36 is an elongated, wider rectangular wall. Two side walls 38, 40 extend between walls 34, 36 and each has an angled upper edge 42, 44 corresponding to the first wall 32, a front edge 46, 48 and a rear edge 50, 52 and a bottom edge 54, 56. The top member 30 is preferably fabricated from metal, but any suitable material can be used.

The dimensions of the walls are shown as D1 for front wall 34, D2 for rear wall 36, D3 for top wall 32, and D4 for bottom wall 37. Dimension D1 can preferably be about 2.75 inches, while dimension D2 can range from about 10.5 inches to about 12.875 inches. Dimension D3 can vary from about 14.719 inches to about 19.34 inches, while dimension D4 can range from about 12.75 inches to about 16.75 inches. However, other dimensions are contemplated by the disclosure.

The front edges 46, 48 and rear edges 50, 52 are parallel to each other, while the upper edges 42, 44 are positioned at an angle A with respect to the bottom edges 54, 56. The angle A of the top wall 32 can vary, but preferably it is around 30 to 60 degrees. Angle B can also be between 30 and 60 degrees. The top wall is essentially flat from edge to edge, but the top wall may also have a curvature if preferred.

Referring now to FIG. 3, the sloped bin header may also have a door 60 which is hinged via hinge 62 to the top wall 32. The door can be secured in a closed position by a lock, a strap, Velcro, or any suitable locking means. A storage area or bin 64 is formed by the internal area formed by walls 32, 34, 36, 37, 38, 39, 40. Various articles can be placed within bin 62 and held in place by door 60. Door 60 can have a lock or lever 65 to open and lock the door.

As seen in FIG. 1, the sloped bin header is placed onto an upper wall 16 of bin or cabinet 10 which has a plurality of holes 66 which align with corresponding holes 68 on the bottom wall 37 of the sloped bin header. Fasteners such as screws, bolts, etc. are used to secure the sloped bin header to the top surface of the cabinet.

Figure 4:
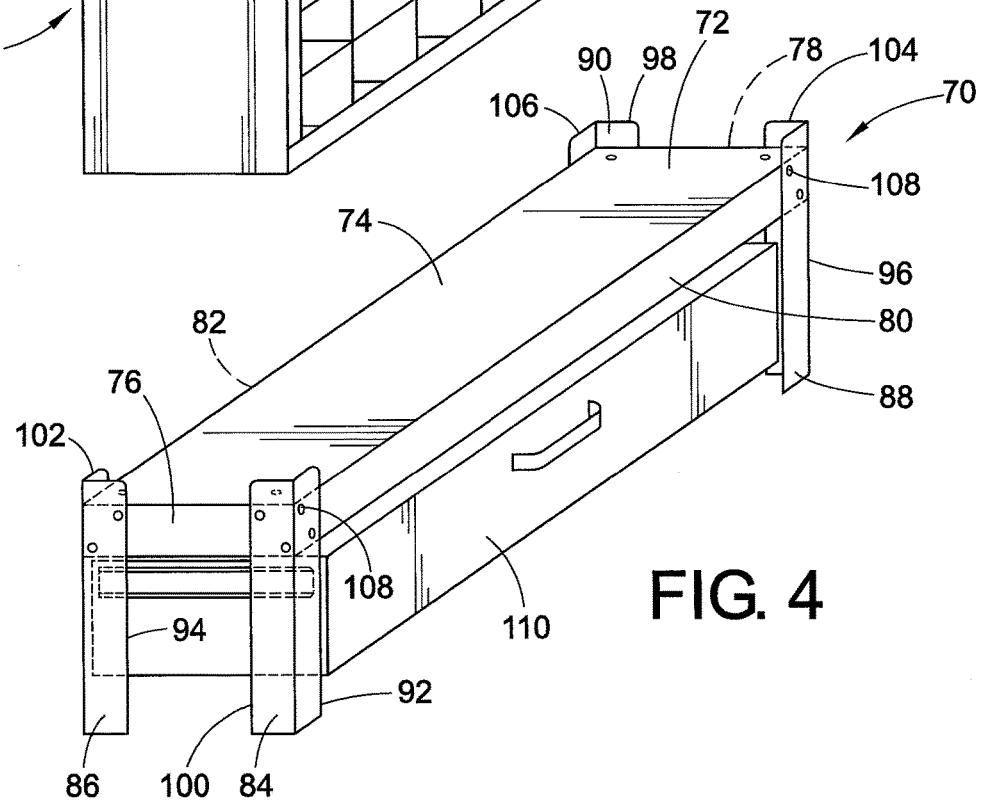
FIG. 4 is a perspective view of a base stand for the storage cabinet in accordance with another aspect of the disclosure.

Referring now to FIG. 4, the entire assembly of the sloped bin header and cabinet may be further mounted to a base stand 70.

The base stand has an upper member 72 including an upper wall 74 and side walls 76, 68, 80, 82 extending therefrom. Four leg members 84, 86, 88, 90 are vertically mounted to side walls 78, 80. The legs are each bent at 90 degrees and have a first portion 92, 94, 96, 98 and a second portion 100, 102, 104, 106 extending at about 90 degrees with respect to the first portion. Each leg is secured to the top member via holes 108 via fasteners (not shown). The legs extend above the top surface of upper wall 74 to provide lateral support to the cabinet. A slidable drawer 110 can be provided below upper member 72.

Figure 5:
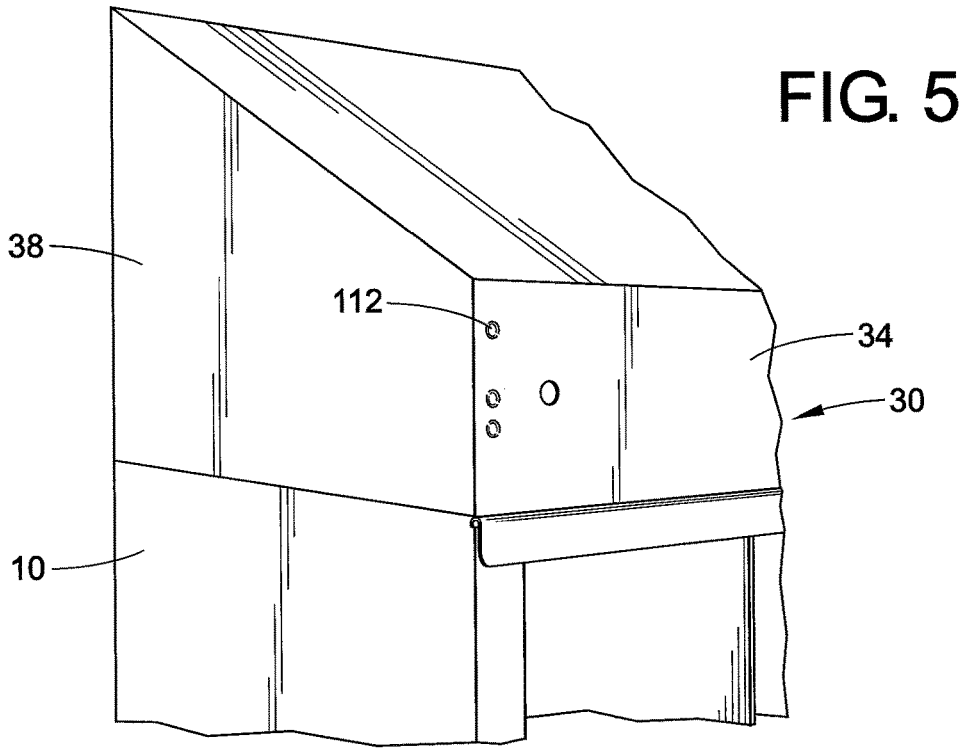
FIG. 5 is an enlarged partial perspective view of a first portion of the sloped bin top member of FIG. 1.
Figure 6:
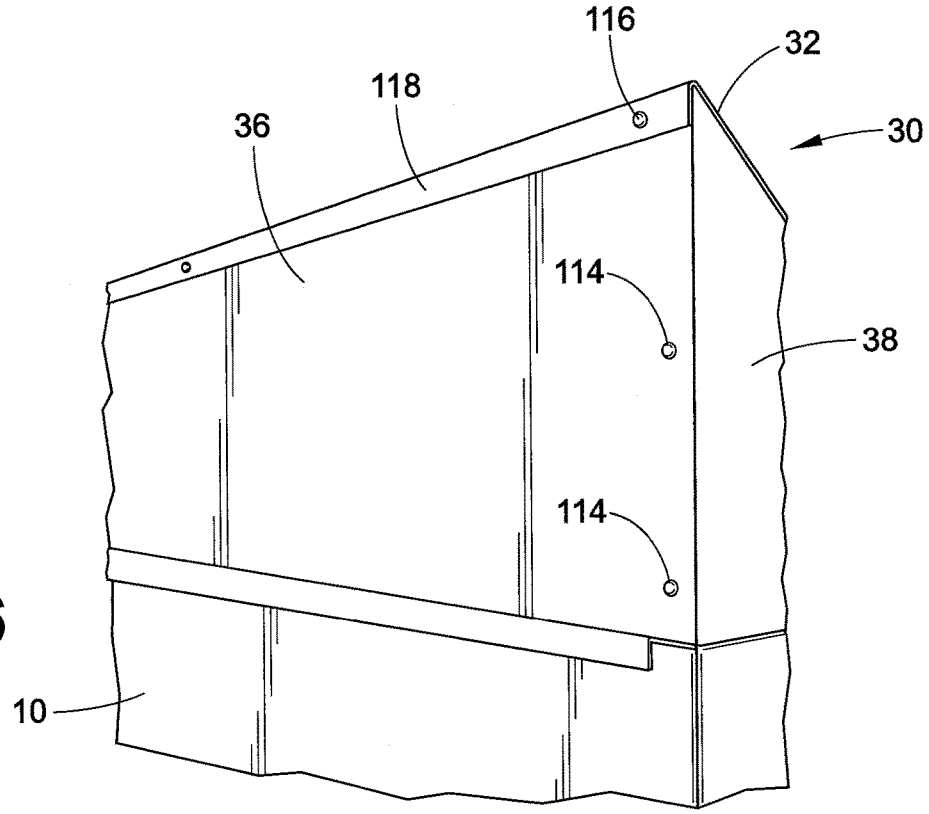
FIG. 6 is an enlarged partial perspective view of a rear portion of the sloped bin top member of FIG. 1.

Referring now to FIG. 5, front wall 34 of sloped header 30 is riveted or otherwise fastened to side walls 38, 40 via rivets or fasteners 112. Similarly, referring to FIG. 6, rear wall 36 is riveted or fastened to side walls 38, 40 via rivets or fasteners 114. Top wall or first wall 32 is riveted or fastened to rear wall 36 via rivets or fasteners 116 which extend through openings formed in bent portion 118 of top wall 32.

Figure 7:
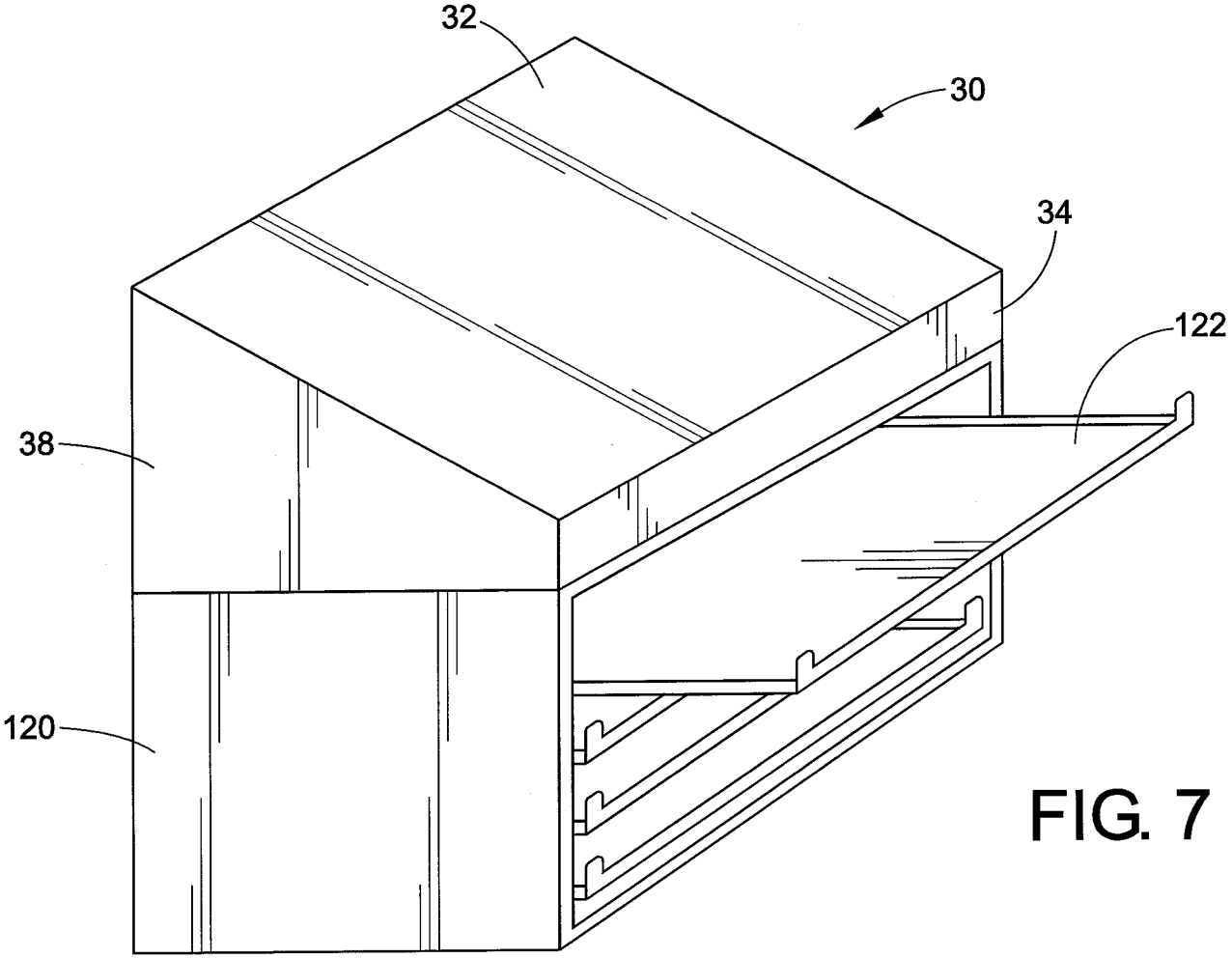
FIG. 7 is a perspective view of a sloped bin top member mounted on a shelved cabinet in accordance with another aspect of the disclosure.

Referring now to FIG. 7, the sloped bin header 30 may also be directly attached to a cabinet 120 having a plurality of slidable drawers 122 therein.

Figure 8:
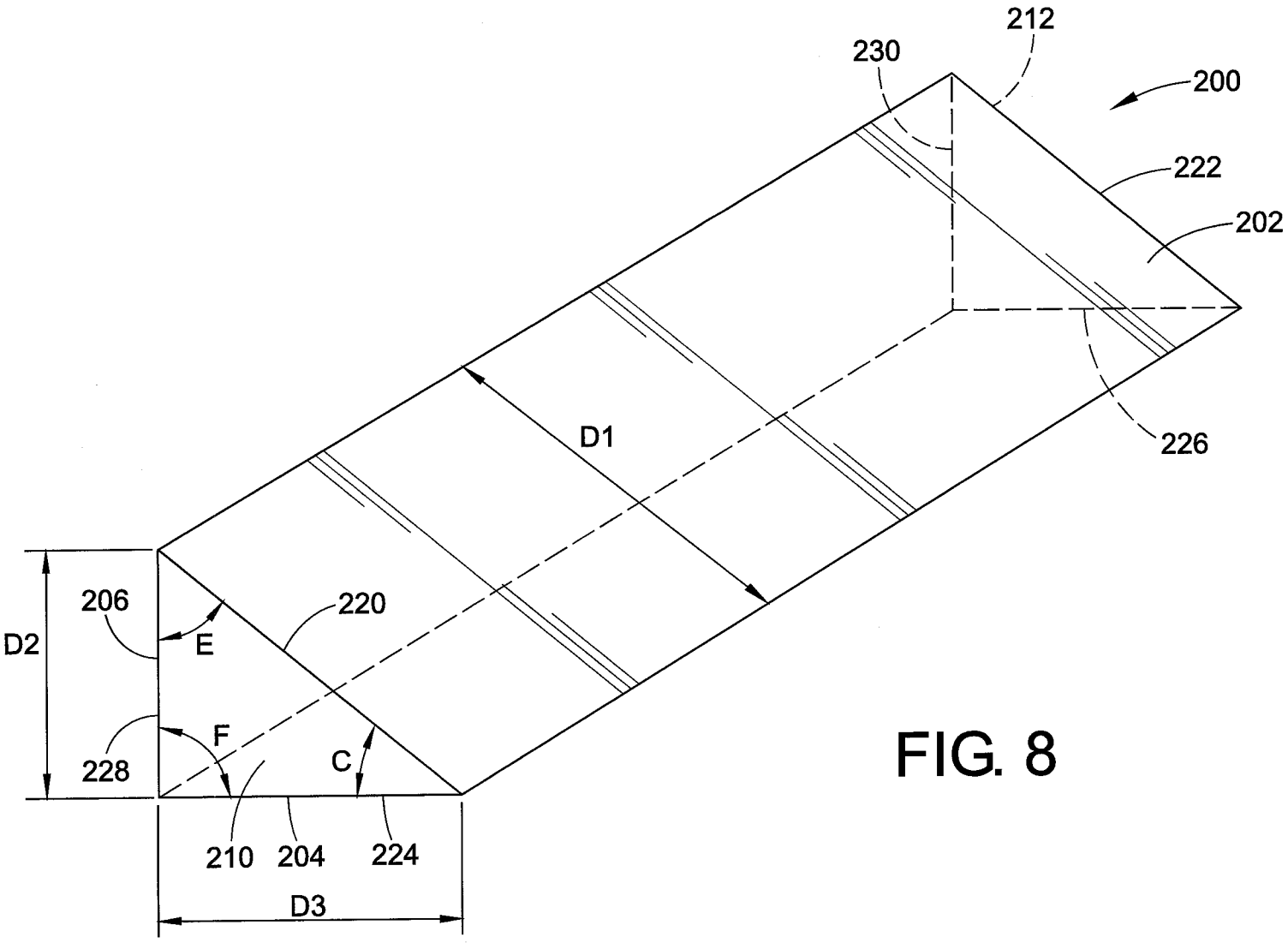
FIG. 8 is a perspective view of an angled bin header in accordance with another aspect of the disclosure.
Figure 9:
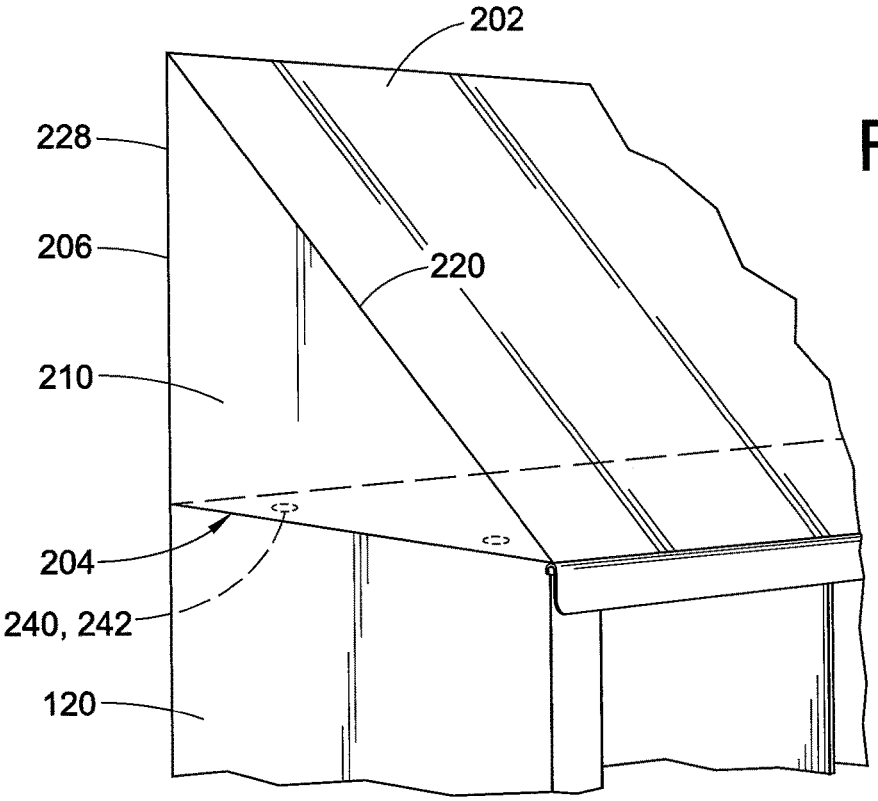
FIG. 9 is an enlarged partial perspective view of a front portion of the angled bin header of FIG. 8.
Figure 10:
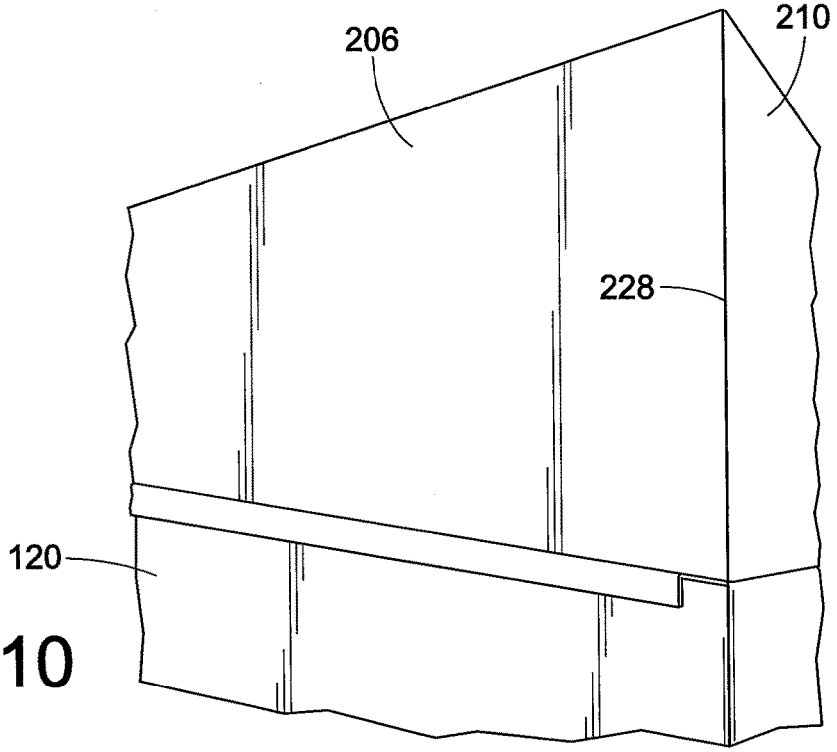
FIG. 10 is an enlarged partial perspective view of a rear portion of the angled bin header of FIG. 8.

Referring now to FIGS. 8-10, an angled bin header or top member 200 in accordance with another aspect of the disclosure is shown. The top member 200 has a first or top wall 202 which is angled or sloped at an angle C with respect to a second or bottom wall 204 and is angled or sloped at an angle E with respect to a third or rear wall 206. Bottom wall 204 extends between and connects top wall 202 and rear wall 206.

Two side walls 210, 212 extend between walls 202, 204, 206 and each has a triangular shape with a first edge 220 formed between top wall 202 and side wall 210, a second edge 222 formed between the top wall 202 and side wall 212. A third edge 224 is formed between side wall 210 and bottom wall 204 and a fourth edge 226 is formed between side wall 212 and bottom wall 204. A fifth edge 228 is formed between side wall 210 and rear wall 206 and a sixth edge 230 is formed between side wall 212 and rear wall 206.

The dimensions of the walls are shown as D1 for the front wall, D2 for the rear wall, and D3 for the bottom wall. Dimension D2 can range from about 8.5 inches to about 10 inches. Dimension D1 can vary from about 14.7 inches to about 19.50 inches, while dimension D3 can range from about 12.75 inches to about 16.75 inches. However, other dimensions and ranges of dimensions are contemplated by the disclosure.

Angle C formed between top wall 202 and bottom wall 204 can vary, but preferably it is around 30 to 45 degrees. The top wall is essentially flat from edge to edge, but the top wall may also have a curvature if preferred. An angle E formed between top wall 202 and rear wall 206 can also vary, but is preferably around 45 to 60 degrees. An angle F formed between rear wall 206 and bottom wall 204 is 90 degrees, but could also vary somewhat.

As seen in FIG. 9, the angled bin header may be placed onto an upper wall of bin 10 which has a plurality of holes 240 which align with corresponding holes 242 on the bottom wall of the angled bin header. Fasteners such as screws, bolts, etc. are used to secure the sloped bin header to the top surface of the cabinet.

The entire assembly of the sloped bin header and cabinet may be further mounted to a base stand 70.

Referring now to FIG. 10, the angled bin header 200 may be formed as one piece with the front wall 202 integrally formed with a rear wall 206 and bottom walls 204.

In accordance with another aspect of the disclosure, a method of preventing placement of articles on a top surface of a cabinet, includes the following steps. First, a top member 30 is provided having a top wall 32, a bottom wall 37, a rear wall 36, and first and second side walls 38, 40. Second, openings 68 are provided in the bottom wall of the top member. Third, openings 68 are provided in the top surface of the cabinet 10. Fourth, the top member 30 is mounted to the cabinet 10 via fasteners extending through the openings 68 of the top member and the openings 66 of the cabinet.

The sloped bin header may also be directly attached to a cabinet having a plurality of slidable drawers therein.

The drawers can be compartmentalized or otherwise configured to hold screws, nuts, bolts, and other articles. The storage of many articles in the drawers may result in them becoming heavily loaded. As such, there is the possibility of toppling of the cabinet especially if articles are also placed on the top surface of the cabinet 120. By providing the sloped bin header on the upper surface of the cabinet, the cabinet is less likely to topple over thus preventing injury to a user or damage to the cabinet or articles being stored.

Furthermore, the sloped bin header helps prevent dust or dirt from accumulating on the top of the cabinets described herein.

The exemplary embodiment has been described with reference to the preferred embodiment. Obviously, modifications and alterations will occur to others upon a reading and understanding of the detailed description. It is intended that the exemplary embodiment and appended claims be construed as including all such modifications and alterations.

The invention claimed is:

1. A sloped bin cover in combination with a storage bin, said bin cover comprising:

a front wall, a rear wall, a top wall extending between said front and rear walls, wherein said top wall comprises a bent portion which mounts to said rear wall and a bottom wall extending between said front and rear walls wherein said bottom wall comprises a plurality of openings, and fasteners which extend through said openings and openings of said storage bin for fastening said sloped bin cover to a top surface of said storage bin; and first and second side walls interconnecting said top, front, rear, and bottom walls wherein said first and second side walls of said sloped bin cover align with first and second side walls of said storage bin and extend along an entire length of said first and second side walls of the bin; and said front and rear walls of said sloped bin cover extend the entire length of front and rear walls of said storage bin;

wherein said top wall forms a first angle with respect to said front wall and a second angle with respect to said rear wall; and wherein said top wall comprises a sloped surface which completely covers said top surface of said storage bin and is configured to prevent associated articles from being placed on said top surface of said bin, wherein said sloped bin cover is made of metal.

2. The sloped bin cover of claim 1, wherein said top wall comprises an opening having a door mounted thereon.

3. The sloped bin cover of claim 2, wherein said door is mounted via a hinge to said top wall opening.

4. The sloped bin cover of claim 1, wherein said first angle of said sloped bin cover is about 30 degrees.

5. The sloped bin cover of claim 1, wherein said second angle of said sloped bin cover is about 60 degrees.

6. A sloped bin cover and storage bin, comprising:

a storage bin having an upper wall, side walls, a bottom wall and rear wall and a plurality of openings forming open shelves extending across a front portion of said bin;

a sloped bin cover comprising a front wall, a rear wall, a top wall extending between said front and rear walls, wherein said top wall comprises a bent portion which mounts to said rear wall and a bottom wall extending between said front and rear walls; and first and second side walls interconnecting said top, front, rear, and bottom walls wherein said bottom wall of said sloped bin cover comprises a plurality of openings, and fasteners which extend through said openings and openings in an upper wall of said bin for fastening said sloped bin cover to said upper wall of said bin and wherein said bottom wall covers an entirety of said upper wall of said bin;

wherein said top wall has a first angle with respect to said front wall and said top wall has a second angle with respect to said rear wall; wherein said top wall forms a sloped surface; and wherein said sloped surface covers an entirety of said upper wall of the storage bin and is configured to prevent placement of associated articles on said upper wall of said bin.

7. The sloped cabinet cover of claim 6, wherein said top wall of said sloped cabinet cover comprises an opening having a door mounted thereon.

8. The sloped cabinet cover of claim 7, wherein said door is mounted via a hinge to said top wall opening.

9. The sloped cabinet cover of claim 6, wherein said sloped cabinet cover is made of metal.

10. The sloped cabinet cover of claim 6, wherein said first angle of said top wall of said sloped cabinet cover is about 30 degrees.

11. The sloped cabinet cover of claim 6, wherein said second angle of said top wall of said sloped cabinet cover is about 60 degrees.

* * * * *